US011022142B2

(12) United States Patent
Choi et al.

(10) Patent No.: US 11,022,142 B2
(45) Date of Patent: Jun. 1, 2021

(54) DIFFUSER FOR COMPRESSOR

(71) Applicant: HANWHA AEROSPACE CO., LTD., Changwon-si (KR)

(72) Inventors: Jae Ho Choi, Changwon-si (KR); Se Mi Kim, Changwon-si (KR)

(73) Assignee: HANWHA AEROSPACE CO., LTD., Changwon-si (KR)

( * ) Notice: Subject to any disclaimer, the term of this patent is extended or adjusted under 35 U.S.C. 154(b) by 93 days.

(21) Appl. No.: 16/121,943

(22) Filed: Sep. 5, 2018

(65) Prior Publication Data

US 2019/0226493 A1 Jul. 25, 2019

(30) Foreign Application Priority Data

Jan. 24, 2018 (KR) ..... 10-2018-0008588

(51) Int. Cl.
*F04D 29/44* (2006.01)
*F04D 17/10* (2006.01)

(52) U.S. Cl.
CPC ..... *F04D 29/444* (2013.01); *F04D 17/10* (2013.01); *F04D 29/441* (2013.01); *F05D 2230/53* (2013.01); *F05D 2240/12* (2013.01)

(58) Field of Classification Search
CPC ..... F04D 29/44; F04D 29/444; F04D 29/448; F04D 17/10; F05D 2240/12
See application file for complete search history.

(56) References Cited

U.S. PATENT DOCUMENTS 5,516,263 A * 5/1996 Nishida ..... F04D 29/444 415/208.2
6,540,481 B2 * 4/2003 Moussa ..... F01D 9/045 415/208.2
7,717,672 B2 * 5/2010 Barton ..... F01D 9/041 415/208.2
9,109,602 B2 * 8/2015 Song ..... F04D 13/10
9,890,792 B2 * 2/2018 Tarnowski ..... F04D 29/444
10,527,059 B2 * 1/2020 Musgrave ..... F04D 25/024
2016/0053774 A1 * 2/2016 Tarnowski ..... F04D 29/444 415/207
2017/0051755 A1 * 2/2017 Liu ..... F04D 25/08
2017/0102005 A1 * 4/2017 Schuldt ..... F02B 33/40
2018/0023586 A1 * 1/2018 Scotti Del Greco ..... F04D 29/444 416/1
2018/0347584 A1 * 12/2018 Larosiliere ..... F04D 29/444
2020/0011345 A1 * 1/2020 Hermes ..... F04D 29/44

FOREIGN PATENT DOCUMENTS

KR 10-2011-0125717 A 11/2011
KR 10-1408140 B1 6/2014
KR 10-2015-0138291 A 12/2015

* cited by examiner

*Primary Examiner* — Courtney D Heinle
*Assistant Examiner* — Sang K Kim
(74) *Attorney, Agent, or Firm* — Sughrue Mion, PLLC

(57) ABSTRACT

A diffuser for a compressor includes a body having a ring shape and including: a fluid inflow face extending along a radial direction of the diffuser; and a rim bent from the fluid inflow face; main vanes formed on the fluid inflow face and the rim to guide fluid; and at least one splitter vane disposed between adjacent main vanes of the main vanes to guide the fluid.

15 Claims, 9 Drawing Sheets

DIFFUSER FOR COMPRESSOR

CROSS REFERENCE TO THE RELATED APPLICATION

This application claims priority from Korean Patent Application No. 10-2018-0008588 filed on Jan. 24, 2018 in the Korean Intellectual Property Office, the disclosure of which is incorporated herein by reference in its entirety.

BACKGROUND

1. Field of the Disclosure

Apparatuses consistent with exemplary embodiments relate to a diffuser for a compressor, and more particularly to a diffuser for a compressor in which diffuser vanes and a deswirler are integrally formed.

2. Description of the Related Art

A gas turbine engine rotates a turbine by combusting fuel. The fuel may be combusted by a combustor, which requires a large amount of air to do so.

A compressor may be used to supply a sufficient amount of air to the combustor. The compressor compresses a large amount of air to supply the compressed air to the combustor. The combustor then combusts the fuel using the supplied air.

Typically, the compressor includes a diffuser to control the flow of the air. The diffuser may include diffuser vanes and a deswirler. The air guided toward the diffuser vanes enters through the deswirler, where the flow angle changes and energy loss may occur.

Therefore, minimizing/reducing the flow loss of the air entering the diffuser by a deswirler is desired.

SUMMARY

One or more exemplary embodiments may provide a diffuser for a compressor in which diffuser vanes and a deswirler are integrally formed to reduce the energy loss.

It should be noted that objects of the present disclosure are not limited to the above-described objects, and other objects of the present disclosure will be apparent to those skilled in the art from the following descriptions According to an aspect of an exemplary embodiment, there is provided a diffuser for a compressor including a body having a ring shape and including a fluid inflow face broadly formed along a radial direction of the ring and a rim bent from the fluid inflow face; main vanes formed along the fluid inflow face and the rim to guide an introduced fluid; and at least one splitter vane disposed between two adjacent ones of the main vanes to guide the introduced fluid.

Each of the main vanes and the at least one splitter vane may include: a radial guide portion provided along the fluid inflow face; an axial guide portion provided along the rim; and a connection guide portion connecting the radial guide portion with the axial guide portion.

The main vanes and the at least one splitter vane may be provided on the body such that a longer axis of the radial guide portion is inclined with respect to a virtual line radially extended from a center of the body.

The main vanes may be disposed on the body such that a distance between the radial guide portions of two adjacent main vanes becomes larger toward an outer side from the center of the body.

The radial guide portions of the at least one splitter vane may be formed to be shorter than the radial guide portions of the main vanes.

Each of the radial guide portions of the main vanes may include a straight region adjacent to the center of the body.

Each of the radial guide portions of the main vanes may include two inflection points.

The fluid inflow face may be inclined toward the center axis of the body.

At least one splitter vane may be disposed between every two adjacent main vanes.

Particulars in the exemplary embodiments of the present disclosure will be described in the detail description with reference to the accompanying drawings.

According to an aspect of another exemplary embodiment, there is provided a diffuser for a compressor, including: a body having a ring shape and including: a fluid inflow face extending along a radial direction of the diffuser; and a rim bent from the fluid inflow face; main vanes formed on the fluid inflow face and the rim to guide fluid; and at least one splitter vane disposed between adjacent main vanes of the main vanes to guide the fluid.

Each of the main vanes and the at least one splitter vane may include: a radial guide portion provided on the fluid inflow face; an axial guide portion provided on the rim; and a connection guide portion connecting the radial guide portion with the axial guide portion.

The main vanes and the at least one splitter vane may be provided on the body such that an axis of each of the radial guide portion of the main vanes and the at least one splitter vane is inclined with respect to a virtual line radially extended from a center of the body in the radial direction.

The main vanes may be disposed on the body such that a distance between the radial guide portions of two adjacent main vanes of the main vanes becomes larger toward an outer side from the center of the body in the radial direction.

A radial length of the radial guide portion of the at least one splitter vane may be shorter than that of each of the radial guide portions of the main vanes.

Each of the radial guide portions of the main vanes may include a straight region adjacent to the center of the body.

The main vanes or the at least one splitter vane may include a plurality of inflection points.

The plurality of inflection points may be formed in the radial guide portions of the main vanes or the at least one splitter vane.

The plurality of inflection points may include two inflection points.

The radial guide portions of the main vanes and the at least one splitter vane may be connected non-angularly to the connection guide portions of the main vanes and the at least one splitter vane, respectively. The axial guide portions of the main vanes and the at least one splitter vane may be connected non-angularly to the connection guide portions of the main vanes and the at least one splitter vane, respectively.

The fluid may be introduced into the radial guide portions and guided by the connection guide portions to be transmitted to the axial guide portions.

A thickness of each of the radial guide portions may gradually increase away from the center of the body.

Two splitter vanes may be disposed on the body such that a distance between the radial guide portions of the two adjacent splitter vanes becomes larger away from the center of the body in the radial direction.

A thickness of each of the main vanes and the at least one splitter vane may vary along the radial direction.

At least a part of each of the main vanes and the at least one splitter vane may be formed in a streamlined shape.

The at least one of the splitter vanes may be disposed between every two adjacent main vanes.

According to an aspect of another exemplary embodiment, there is provided a diffuser for a compressor, including: a body including: a through hole configured to engage with an impeller; an inner portion extending along a radial direction of the diffuser; and an outer bent portion bent from the inner portion; a plurality of first vanes extending along the inner portion and the outer bent portion to guide fluid from the inner portion to the outer bent portion; and at least one second vane disposed between adjacent first vanes of the plurality of first vanes to guide the fluid. A radial length of the at least one second vane is shorter than that of each of the plurality of first vanes.

Each of the first vanes may include: a radial guide portion provided on the inner portion; an axial guide portion provided on the outer bent portion; and a connection guide portion connecting the radial guide portion with the axial guide portion. The at least one second vane may include: a radial guide portion provided on the inner portion; an axial guide portion provided on the outer bent portion; and a connection guide portion connecting the radial guide portion with the axial guide portion.

A thickness of each of the plurality of first vanes in a circumferential direction of the diffuser may vary along the radial direction. A thickness of the at least one second vane in the circumferential direction may vary along the radial direction.

Each of the plurality of first vanes may include a plurality of inflection points along the radial direction.

According to an aspect of an exemplary embodiment, diffuser vanes and a deswirler are integrally formed, so that energy loss caused when the flow angle is changed at the inlet of the deswirler can be prevented.

It should be noted that effects of the present disclosure are not limited to the above-described effects, and other effects of the present disclosure will be apparent to those skilled in the art from the following descriptions.

BRIEF DESCRIPTION OF THE DRAWINGS

The above and/or other aspects and features of the present disclosure will become more apparent by describing in detail exemplary embodiments thereof with reference to the attached drawings, in which.

DETAILED DESCRIPTION

Figure 1:
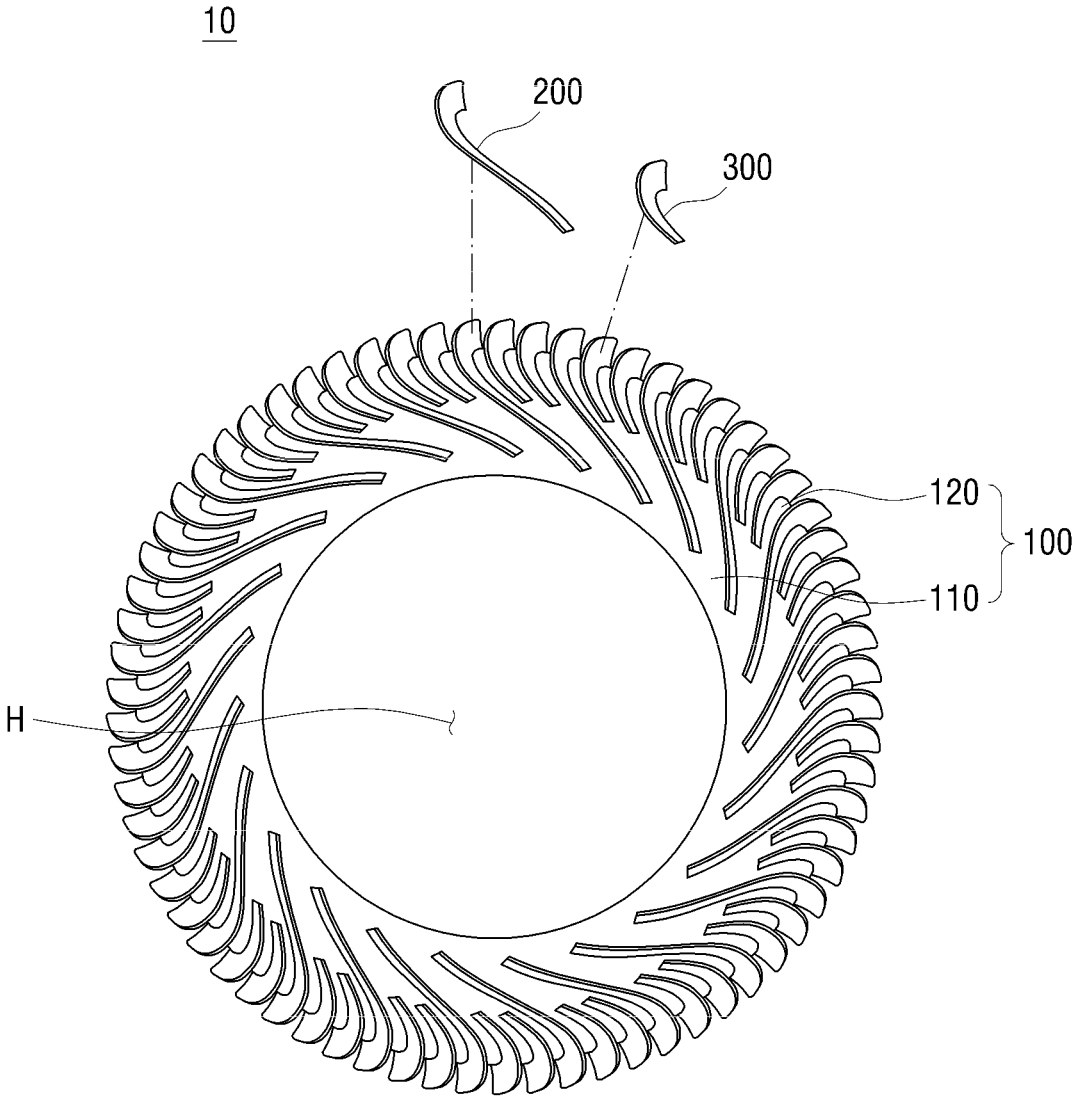
FIG. 1 is a perspective view of a diffuser for a compressor according to an exemplary embodiment.

Hereinafter, exemplary embodiments of the present disclosure will be described in detail with reference to the accompanying drawings. Advantages and features of the present disclosure and methods to achieve them will become apparent from the descriptions of exemplary embodiments herein below with reference to the accompanying drawings. However, the present disclosure is not limited to the exemplary embodiments disclosed herein but may be implemented in various different ways. The exemplary embodiments are provided for making the disclosure of the present disclosure thorough and for fully conveying the scope of the present disclosure to those skilled in the art. It is to be noted that the scope of the present disclosure is defined solely by the claims. Like reference numerals denote like elements throughout the descriptions.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

Figure 2:
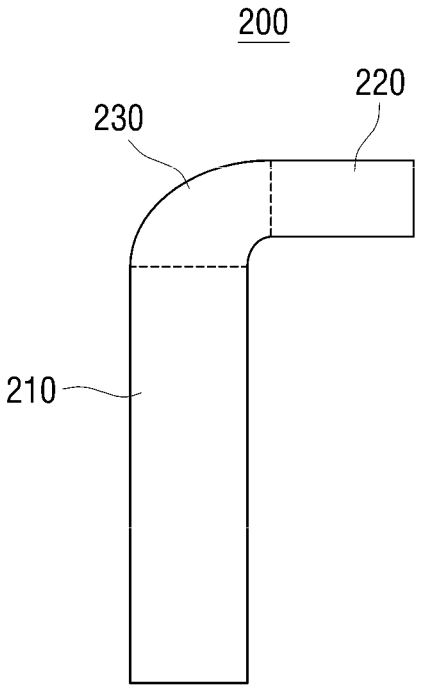
FIG. 2 is a front view of a main vane according to an exemplary embodiment.
Figure 3:
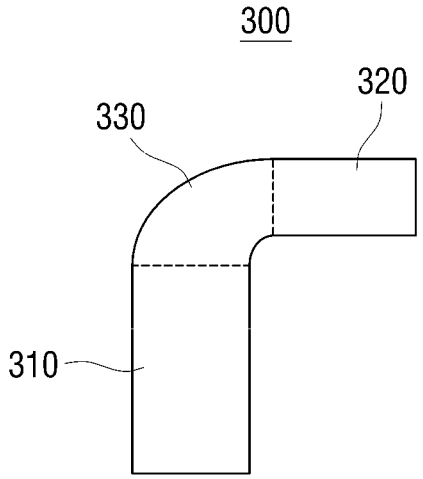
FIG. 3 is a front view of a splitter vane according to an exemplary embodiment.

FIG. 1 is a perspective view of a diffuser 10 for a compressor (not shown) according to an exemplary embodiment. FIG. 2 is a front view of a main vane 200 according to an exemplary embodiment. FIG. 3 is a front view of a splitter vane 300 according to an exemplary embodiment.

Referring to FIG. 1, a diffuser 10 for a compressor includes a body 100, main vanes 200 and splitter vanes 300.

The body 100 serves to support the main vanes 200 and the splitter vanes 300. The body 100 may have a ring shape. Specifically, the body 100 may have a disc-like through hole H through which an impeller 20 (FIG. 4) is mounted.

The body 100 having the ring shape may include a fluid inflow face 110 and a rim 120. The fluid inflow face 110 refers to the face at which the fluid from the impeller is received. The fluid inflow face 110 may be formed to be wider along the radial direction of the ring. The rim 120 may be bent and extended from the fluid inflow face 110.

The main vanes 200 and the splitter vanes 300 may be attached to the body 100. Each of the main vanes 200 and the splitter vanes 300 may have a plate shape. That is, each of the main vanes 200 and the splitter vanes 300 may have at least one surface for guiding fluid. In addition, each of the main vanes 200 and the splitter vanes 300 may have two or more inflection points (See FIG. 5). The moving direction of the fluid flowing along the main vanes 200 and the splitter vanes 300 may be changed at the inflection points.

The main vanes 200 and the splitter vanes 300 according to an exemplary embodiment of the present disclosure may have a plate-like shape and may guide the fluid to both sides. The thickness of the main vanes 200 and the splitter vanes 300 may be either constant or variable along a radial direction of the main vanes 200 or the splitter vanes 300. When the plate has different thicknesses, the thicknesses of the main vanes 200 and the splitter vanes 300 may vary in a streamline shape to produce a smooth flow of the fluid.

The main vanes 200 and the splitter vanes 300 may be disposed along the fluid inflow face 110 and the rim 120 of the body 100 to guide the fluid introduced from the impeller. At least one of the splitter vanes 300 may be disposed between two adjacent main vanes 200 to guide the fluid. In the exemplary embodiment shown in FIG. 1, two splitter vanes 300 are disposed between every two adjacent main vanes 200.

Referring to FIGS. 2 and 3, each of the main vanes 200 may include a radial guide portion 210, an axial guide portion 220, and a connection guide portion 230. In addition, each of the splitter vanes 300 may include a radial guide portion 310, an axial guide portion 320, and a connection guide portion 330.

The radial guide portions 210 and 310 of the main vanes 200 and the splitter vanes 300, respectively, may be provided along the fluid inflow face 110 of the body 100. The axial guide portions 220 and 320 may be provided along the rim 120 of the body 100. The radial guide portions 210 and 310 may be attached on the fluid inflow face 110 along the radial direction of the body 100. The axial guide portions 220 and 320 may be attached on the rim 120 along the axial direction of the body 100. To this end, the side of the radial guide portions 210 and 310 attached on the fluid inflow face 110 may conform to the shape of the fluid inflow face 110, and the side of the axial guide portions 220 and 320 attached on the rim 120 may conform to the shape of the rim 120.

As described above, the main vanes 200 and the splitter vanes 300 guide fluid generated from an impeller and the fluid may move outward from the center of the body 100 (from the fluid inflow face 110 to the rim 120). Accordingly, the fluid can be introduced through the lower ends of the radial guide portions 210 and 310 of the main vanes 200 and the splitter vanes 300. The introduced fluid may flow along the radial guide portions 210 and 310 and then may be transmitted to the axial guide portions 220 and 320.

The axial guide portions 220 and 320 may be extended generally in the axial direction of the diffuser. The fluid may travel in the axial direction (from the left side toward the right side of the FIGS. 2 and 3) by being guided by a housing (not shown) that accommodate the diffuser 10 for a compressor and the axial guide portions 220 and 320.

The connection guide portions 230 and 330 serve to connect the radial guide portions 210 and 310 with the axial guide portions 220 and 320 of the main vanes 200 and the splitter vanes 300, respectively. The fluid guided by the radial guide portions 210 and 310 may be transmitted to the axial guide portions 220 and 320 via the connection guide portions 230 and 330.

As the radial guide portions 210 and 310 are connected to the axial guide portions 220 and 320 by the connection guide portions 230 and 330, it is possible to prevent the flow loss when the fluid is transmitted from the radial guide portions 210 and 310 to the axial guide portions 220 and 320. If the radial guide portions 210 and 310 and the axial guide portions 220 and 320 were disconnected from each other, the fluid may leak between the radial guide portions 210 and 310 and the axial guide portions 220 and 320, such that flow loss would likely occur. In contrast, according to the exemplary embodiment of the present disclosure, the radial guide portions 210 and 310 are connected to the axial guide portions 220 and 320 by the connection guide portions 230 and 330, and thus it is possible to prevent energy loss caused by a change in the flow angle (from the radial direction to the axial direction of the diffuser).

In addition, in order to guide the fluid in the axial direction (i.e., horizontal direction in FIGS. 2 and 3), the axial guide portions 220 and 320 are required to have a certain length. The connection guide portions 230 and 330 may be connected to one side of the axial guide portions 220 and 320 to guide the fluid in the axial direction together with the axial guide portions 220 and 320.

As the connection guide portions 230 and 330 guide the fluid in the axial direction, the overall length of the axial guide portions 220 and 320 can be reduced. As the length of the axial guide portions 220 and 320 is reduced, the length of the rim 120 (along the axial direction) of the body 100 supporting the axial guide portions 220 and 320 can be reduced. In addition, as the length of the rim 120 (along the axial direction) of the body 100 is reduced, the length of the compressor including the diffuser 10 as well as the length of the engine including the compressor are reduced, such that the overall weight of the engine can be reduced.

Figure 4:
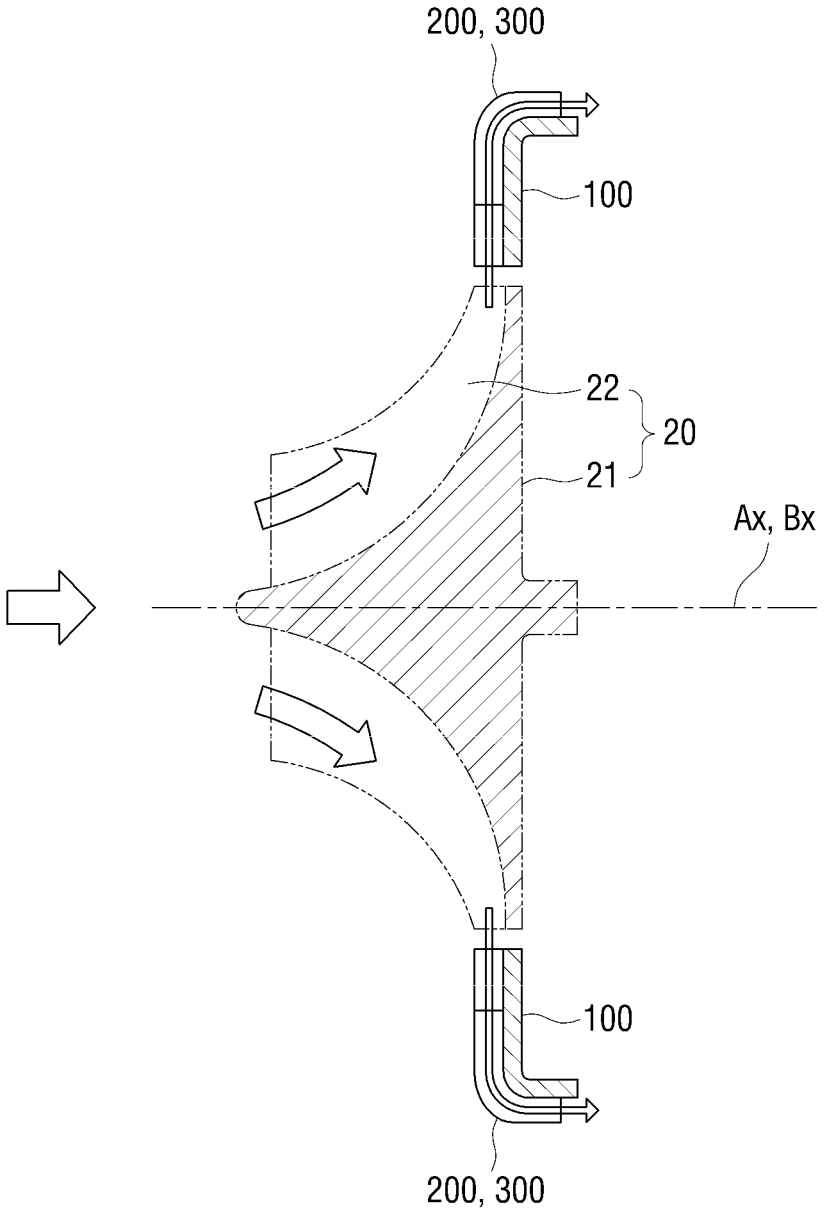
FIG. 4 is a view showing the flow of the fluid introduced into the body and the fluid inflow face according to an exemplary embodiment.

FIG. 4 is a cross-sectional view of a diffuser 10 according to an exemplary embodiment.

Referring to FIG. 4, an impeller 20 is mounted in the through hole H of the diffuser 10. The center axis Ax of the body 100 of the diffuser 10 may be coaxial with the rotation axis Bx of the impeller 20.

The impeller 20 may include a rotating body 21 and a blade 22. As the impeller 20 rotates, the fluid moves outwardly from the blade 22 in the radial direction. The fluid may be introduced from the front of the impeller 20 as shown in the figure. The moving direction of the fluid moving from the blade 22 may be formed in an outward direction from the rotation axis Bx of the impeller 20.

The fluid that has reached the fluid inflow face 110 of the diffuser 10 from the impeller 20 may be guided by the main vanes 200 and the splitter vanes 300 while moving along the surface of the fluid inflow face 110 in the radial direction.

Figure 5:
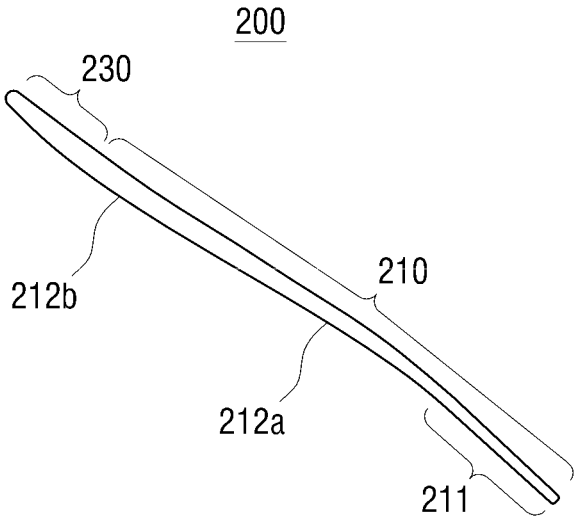
FIG. 5 is a side view of a main vane according to an exemplary embodiment.
Figure 6:
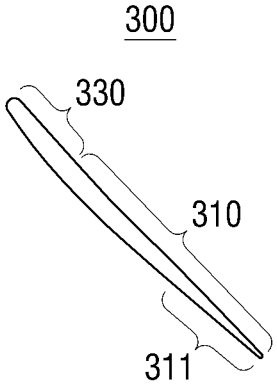
FIG. 6 is a side view of a splitter vane according to an exemplary embodiment.

FIG. 5 is a side view of a main vane 200 according to an exemplary embodiment. FIG. 6 is a side view of a splitter vane 300 according to an exemplary embodiment.

Referring to FIGS. 5 and 6, each of the main vane 200 and the splitter vane 300 may be implemented in the form of a plate.

According to the exemplary embodiments, the thickness of the plate may vary depending on the extending direction (along the circumferential direction and/or the radial direction) of the assemblies of the radial guide portions 210 and 310 and the connection guide portions 230 and 330 of the main vane 200 and the splitter vane 300, respectively. For example, the ratio of the maximum thickness to and the minimum thickness of the main vane 200 and the splitter vane 300 may be less than or equal to 3. As the ratio of the maximum thickness to the minimum thickness of the plate is not greater than 3, the surface of the assemblies of the radial guide portions 210 and 310 and the connection guide portions 230 and 330 may form a flat or streamlined surface. In particular, the thickness at the front end (i.e., an inner radial end) of the radial guide portions 210 and 310 into which the fluid flows is relatively small (the lower right ends in FIGS. 5 and 6), and the thickness may gradually increase in the extending direction (toward the upper left ends in FIGS. 5 and 6).

As the fluid moves along the flat or streamlined surface, eddy is prevented, so that the flow loss due to friction with the surfaces of the radial guide portions 210 and 310 and the connection guide portions 230 and 330 can be reduced.

The radial guide portion 210 of the main vane 200 may include a straight region adjacent to the center of the body 100. Referring to FIG. 5, the front end portion 211 of the radial guide portion 210 is disposed adjacent to the center of the body 100 and the front end portion 211 may include a straight region where the fluid is introduced.

The fluid discharged from the impeller 20 may flow into the front end portion 211 of the radial guide portion 210. In the environment where the velocity of the fluid is close to Mach 1, if the front end portion of the radial guide portion has a curved shape, the fluid may be accelerated too much so that the flow loss due to the shock wave may be increased. In contrast, the front end portion 211 of the radial guide portion 210 according to the exemplary embodiment of the present disclosure has the straight shape, so that the flow acceleration is limited and thus the flow loss can be reduced as compared with the curved shape.

The radial guide portion 210 of the main vane 200 may include two inflection points 212*a* and 212*b*. The moving direction of the fluid may be changed at the inflection points 212*a* and 212*b*. If there is one inflection point, the loss due to friction may increase as the overall length of the vane is long. In contrast, if there is more than one inflection point, the overall length of the vane becomes shorter, such that the loss due to the friction can be reduced, facilitating guiding the fluid. According to an exemplary embodiment of the present disclosure, the radial guide portion 210 includes two inflection points 212*a* and 212*b*, such that the friction between the fluid and the radial guide portion 210 can be relatively small, thereby suppressing the eddy.

The front end portion 311 of the radial guide portion 310 of the splitter vane 300 may be positioned adjacent to the inflection points 212*a* and 212*b* of the main vane 200. Accordingly, the fluid can be smoothly introduced into the splitter vane 300 and guided after its moving direction has been changed.

Although FIG. 5 shows that the radial guide portion 210 has the two inflection points 212*a* and 212*b*, the main vane 200 may include more than two inflection points. For example, the axial guide portion 220 may additionally include an inflection point, or the connection guide portion 230 may additionally include an inflection point. Alternatively, an inflection point may be included between the radial guide portion 210 and the connection guide portion 230 or an inflection point may be included between the connection guide portion 230 and the axial guide portion 220.

In addition, the splitter vane 300 may include two or more inflection points, similar to the main vane 200.

Figure 7:
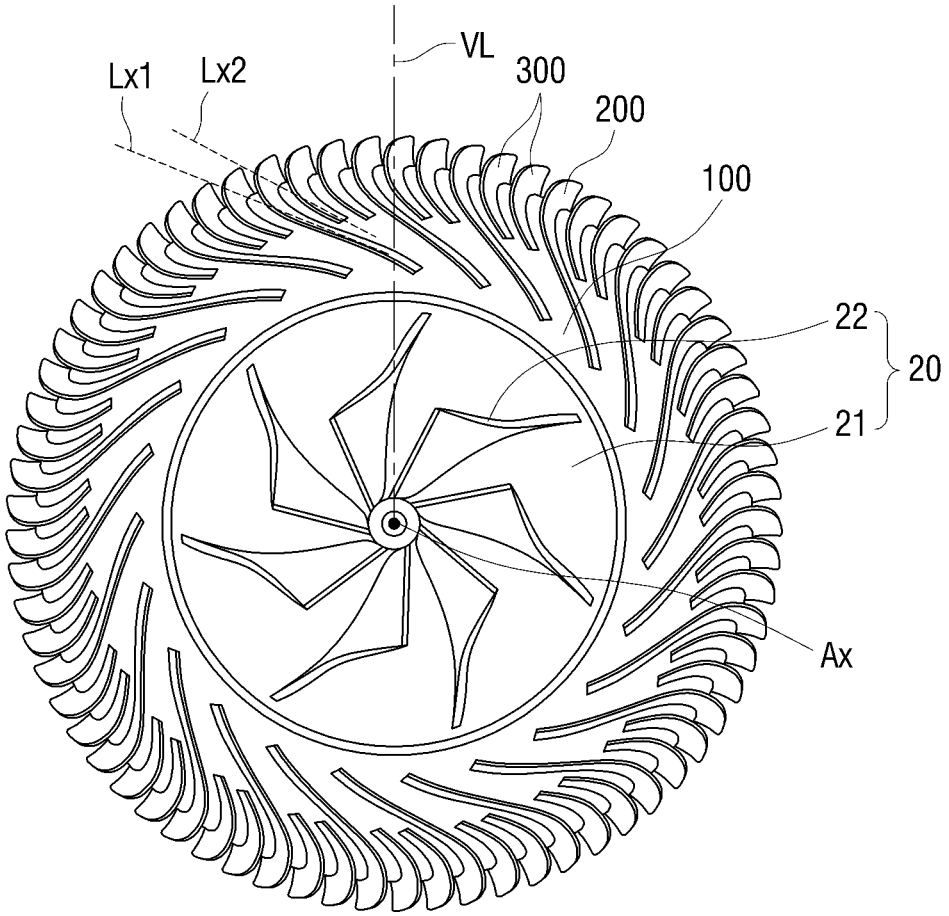
FIG. 7 is a front view of a diffuser for a compressor according to an exemplary embodiment.
Figure 8:
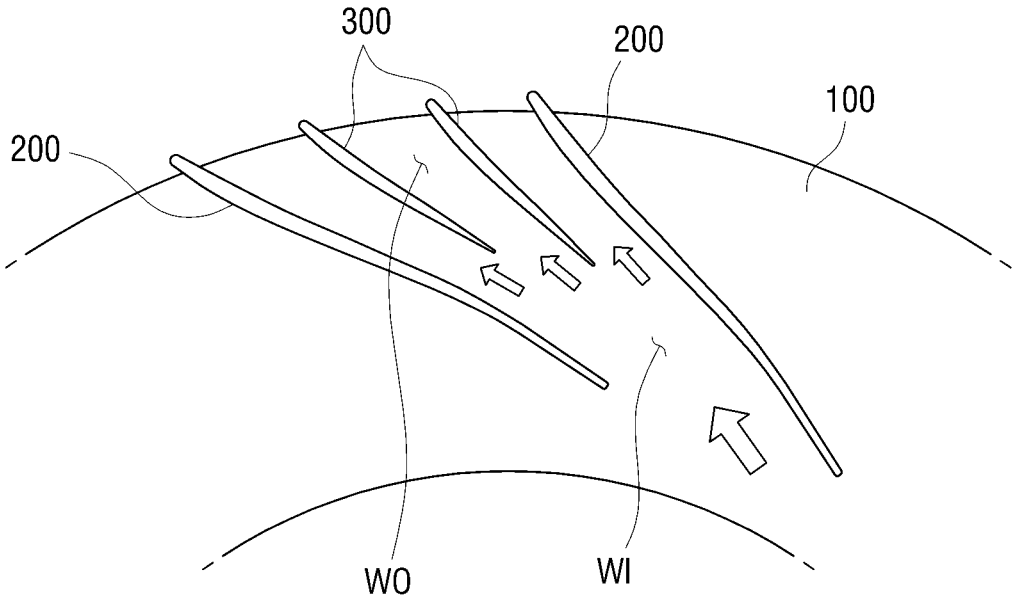
FIG. 8 is a view showing the flow of the fluid guided by main vanes and splitter vanes according to an exemplary embodiment.

FIG. 7 is a front view of a diffuser 10 for a compressor according to an exemplary embodiment. FIG. 8 is a view showing the flow of the fluid guided by main vanes 200 and splitter vanes 300 according to an exemplary embodiment.

Referring to FIG. 7, the main vanes 200 and the splitter vanes 300 may be disposed on the body 100 such that the axes Lx1 and Lx2 of the radial guide portions 210 and 310, respectively, are inclined with respect to the virtual line VL extended radially from the central axis Ax of the body 100.

The end of the blade 22 provided on the impeller 20 may be spaced apart from the rotation axis Bx by a predetermined distance. Accordingly, when the impeller 20 rotates, the moving direction of the fluid discharged from the end of the blade 22 may be bent (or rotated) with respect to the virtual line VL.

The angle between the virtual line VL and the axes Lx1 and Lx2 of the radial guide portions 210 and 310 may be determined depending on the moving direction of the fluid discharged from the blade 22.

Referring to FIG. 8, the two adjacent main vanes 200 may be provided on the body 100 such that the distance between the radial guide portions 210 of the adjacent main vanes 200 gradually increases toward the outer side from the center of the body 100 in the radial direction.

The radial guide portions 310 of the splitter vanes 300 may be shorter than the radial guide portions 210 of the main vanes 200. The splitter vanes 300 may be disposed between the adjacent main vanes 200. The splitter vanes 300 may split the fluid moving along the main vanes 200 (or between the adjacent main vanes 200). As the flow of the fluid is split by the splitter vanes 300, the pressure at an outlet WO formed by the main vanes 200 and the splitter vanes 300 can become relatively uniform along the edge of the body 100.

Further, because the moving path of the fluid becomes relatively small by the splitter vanes 300, it is possible to reduce the eddy by the fluid.

Figure 9:
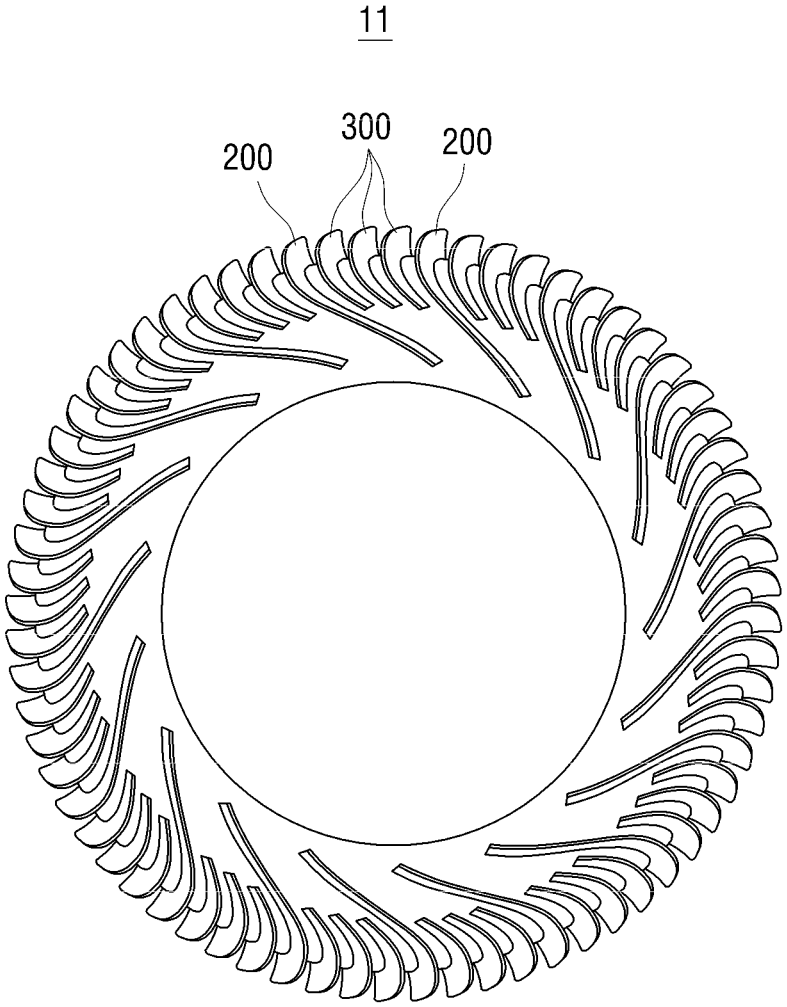
FIG. 9 is a perspective view of a diffuser for a compressor according to another exemplary embodiment.

FIG. 9 is a perspective view of a diffuser for a compressor according to another exemplary embodiment.

Referring to FIG. 9, the diffuser 11 for a compressor according to this exemplary embodiment may include three splitter vanes 300 between every two adjacent main vanes 200 (instead of two as shown in the previous embodiment).

The number of splitter vanes 300 included between the adjacent main vanes 200 may be determined by the size of an inlet WI of the adjacent main vanes 200, the size of the outlet WO of the main vanes 200, the moving speed of the fluid, etc.

Although the exemplary embodiments of the present disclosure have been described with reference to the accompanying drawings, those skilled in the art will appreciate that various modifications and alterations may be made without departing from the spirit or essential features of the present disclosure. Therefore, it should be understood that the above-mentioned embodiments are not limiting but illustrative in all aspects.

What is claimed is:

1. A diffuser for a compressor, comprising:

a body having a ring shape and comprising:

a fluid inflow face extending along a radial direction of the diffuser; and a rim bent from the fluid inflow face;

main vanes formed on the fluid inflow face and the rim to guide fluid; and at least two splitter vanes disposed between every two adjacent main vanes of the main vanes to guide the fluid, wherein each main vane of the main vanes comprises two inflection points formed in a same side edge of a radial guide portion of the main vane, wherein each of the two inflection points is a point in which a change in a direction of curvature occurs, and wherein the radial guide portion of each main vane of the main vanes further comprises a straight region adjacent to a center of the body, the straight region being a radially innermost portion of the main vane that extends straight and has a constant thickness in a circumferential direction of the diffuser.

2. The diffuser of claim 1, wherein each main vane of the main vanes comprises:

the radial guide portion, the radial guide portion provided on the fluid inflow face;

an axial guide portion provided on the rim; and a connection guide portion connecting the radial guide portion of the main vane with the axial guide portion of the main vane, and each splitter vane of the at least two splitter vanes comprises:

a radial guide portion provided on the fluid inflow face;

an axial guide portion provided on the rim; and a connection guide portion connecting the radial guide portion of the splitter vane with the axial guide portion of the splitter vane.

3. The diffuser of claim 2, wherein the main vanes and the at least two splitter vanes are provided on the body such that an axis of each of the radial guide portion of the main vanes and the at least two splitter vanes is inclined with respect to a virtual line radially extended from a center of the body in the radial direction.

4. The diffuser of claim 2, wherein the main vanes are disposed on the body such that a distance between the radial guide portions of two adjacent main vanes of the main vanes becomes larger toward an outer side from a center of the body in the radial direction.

5. The diffuser of claim 2, wherein a radial length of the radial guide portion of the at least two splitter vanes is shorter than that of each of the radial guide portions of the main vanes.

6. The diffuser of claim 2, wherein each of the at least two splitter vanes comprises one or more inflection points.

7. The diffuser of claim 2, wherein the radial guide portions of the main vanes and the at least two splitter vanes are connected continuously to the connection guide portions of the main vanes and the at least two splitter vanes, respectively, and wherein the axial guide portions of the main vanes and the at least two splitter vanes are connected continuously to the connection guide portions of the main vanes and the at least two splitter vanes, respectively.

8. The diffuser of claim 2, wherein the fluid is introduced into the radial guide portions and guided by the connection guide portions to be transmitted to the axial guide portions.

9. The diffuser of claim 2, wherein a thickness of each of the radial guide portions gradually increases away from a center of the body.

10. The diffuser of claim 2, wherein two adjacent splitter vanes of the at least two splitter vanes are disposed on the body such that a distance between the radial guide portions of the two adjacent splitter vanes becomes larger away from a center of the body in the radial direction.

11. The diffuser of claim 1, wherein a thickness of each of the main vanes and the at least two splitter vanes varies along the radial direction.

12. The diffuser of claim 1, wherein at least a part of each of the main vanes and the at least two splitter vanes is formed in a streamlined shape.

13. A diffuser for a compressor, comprising:

a body comprising:

a through hole configured to engage with an impeller;

an inner portion extending along a radial direction of the diffuser; and an outer bent portion bent from the inner portion;

a plurality of first vanes extending along the inner portion and the outer bent portion to guide fluid from the inner portion to the outer bent portion; and at least two second vanes disposed between every two adjacent first vanes of the plurality of first vanes to guide the fluid, wherein a radial length of the at least two second vanes is shorter than that of each of the plurality of first vanes, wherein each first vane of the first vanes comprises two inflection points formed in a same side edge of a radial guide portion of the first vane, wherein each of the two inflection points is a point in which a change in a direction of curvature occurs, and wherein the radial guide portion of each first vane of the first vanes further comprises a straight region adjacent to a center of the body, the straight region being a radially innermost portion of the first vane that extends straight and has a constant thickness in a circumferential direction of the diffuser.

14. The diffuser of claim 13, wherein each first vane of the plurality of first vanes comprises:

the radial guide portion, the radial guide portion provided on the inner portion;

an axial guide portion provided on the outer bent portion; and a connection guide portion connecting the radial guide portion of the first vane with the axial guide portion of the first vane, and wherein each second vane of the at least two second vanes comprises:

a radial guide portion provided on the inner portion;

an axial guide portion provided on the outer bent portion; and a connection guide portion connecting the radial guide portion of the second vane with the axial guide portion of the second vane.

15. The diffuser of claim 13, wherein a thickness of each of the plurality of first vanes in the circumferential direction of the diffuser varies along the radial direction, and wherein a thickness of the at least two second vanes in the circumferential direction varies along the radial direction.

* * * * *